US005641143A

United States Patent [19]

Garza et al.

[11] Patent Number: 5,641,143

[45] Date of Patent: Jun. 24, 1997

[54] CURTAIN ROD BRACKET

[76] Inventors: Norberto C. Garza; Stephanie Garza, both of 7315 Wren Ave., Gilroy, Calif. 95020

[21] Appl. No.: 422,215

[22] Filed: Apr. 14, 1995

[51] Int. Cl.[6] ..... A47H 1/10

[52] U.S. Cl. ..... 248/263; 248/264

[58] Field of Search ..... 248/263, 264, 248/255, 268, 300, 200.1, 644

[56] References Cited

U.S. PATENT DOCUMENTS

| | | | |
|---|---|---|---|
| 551,080 | 12/1895 | Gilfillan et al. | 248/263 |
| 1,276,823 | 8/1918 | Sullivan | 248/263 |
| 1,384,273 | 7/1921 | Palosky et al. | 248/263 |
| 1,675,111 | 6/1928 | Kenney | 248/263 |
| 1,713,299 | 5/1929 | Rasp | 248/263 |
| 1,720,308 | 7/1929 | Vogt | 248/263 |
| 1,752,743 | 4/1930 | Kall | 248/263 |
| 1,969,913 | 8/1934 | Stapledon | 248/263 |
| 2,169,053 | 8/1939 | Lowe | 248/263 |
| 2,210,606 | 8/1940 | Speranza | 248/263 |
| 2,955,794 | 10/1960 | Robbins | 248/263 |
| 3,218,017 | 11/1965 | Butler | 248/263 |
| 4,283,034 | 8/1981 | Sheehan | 248/263 |
| 4,305,562 | 12/1981 | Bellinger | 248/263 |
| 4,684,095 | 8/1987 | Athey | 248/255 |
| 4,694,532 | 9/1987 | Black | 248/263 |
| 4,889,305 | 12/1989 | Mahan | 248/255 |
| 4,964,604 | 10/1990 | Lombard | 248/262 |
| 5,082,226 | 1/1992 | Mahan | 248/265 |
| 5,398,900 | 3/1995 | Schober | 248/263 |

FOREIGN PATENT DOCUMENTS

| | | | |
|---|---|---|---|
| 691319 | 7/1964 | Canada | 248/263 |
| 281975 | 1/1928 | United Kingdom | 248/263 |

*Primary Examiner*—Alvin C. Chin-Shue
*Assistant Examiner*—Willie Berry, Jr.
*Attorney, Agent, or Firm*—Richard C. Litman

[57] ABSTRACT

A bracket for supporting a curtain rod for use with an opening such as a window. The bracket is designed to be mounted on the inside surface of the window frame to prevent marring of the window molding or adjacent wall surface facing the interior of the room and to allow viewing of the window molding and the corner blocks around the window. The bracket is characterized by a main portion, a first extension, and a retaining member. The main portion incudes a hole formed therein for receipt of a wood screw or nail. The first extension projects from the main portion and includes a first end distal to the main portion. The retaining member is displaced from the first end to provide a supporting surface for supporting the curtain rod such that the bracket is capable of supporting the rod in proximity to the window when the main portion is secured to the inside surface of the window frame.

1 Claim, 8 Drawing Sheets

CURTAIN ROD BRACKET

BACKGROUND OF THE INVENTION

1. Field of the Invention

The present invention relates to brackets used to support curtain rods, window shades, draperies and other window treatments.

2. Description of the Prior Art

One of the more common types of curtain rods is the type that is substantially flat and forms an "L" bend at each end of the rod. After a curtain is placed on the rod, the rod is attached to a bracket which is fastened to the molding of an opening, for example a window, or the wall surface adjacent the window. In this arrangement, the curtain is moved apart from the frame of the window, allowing the curtain to hang freely from the window. Normally, this type of curtain rod would include at the end portions an opening within the rod body, so that the end of the rod may slip around the bracket, with the upper point of the bracket engaging a port in the upper wall of the rod, so that the rod is attached to the bracket securely. Example of such brackets are seen in U.S. Pat. No. 1,675,111, issued to William C. Kenney on Jun. 26, 1928; U.S. Pat. No. 3,218,017, issued to Harold E. Butler on Nov. 16, 1965; U.S. Pat. No. 4,283,034 issued to Maurice J. Sheehan on Aug. 11, 1981; and British Pat. No. 281,975, issued to Charles Stafford on Jan. 15, 1928.

One of the concerns with this type of bracket is the fact that the bracket normally includes a rear face having holes formed therein for accommodating tacks or screws to secure the bracket to the window molding or adjacent wall surface. It is necessary, therefore, that corresponding holes be bored into the window molding or adjacent wall surface for receipt of the tacks or screws. The resulting holes are often quite unsightly, particularly when the brackets are removed, leaving the molding surface or wall surface facing the interior of the room flawed with the holes that once held the bracket. A second concern regarding this type of bracket is that by mounting the brackets on the window molding or adjacent window surface, the molding or corner blocks of the window are obscured from view by the curtain rod and curtains. Therefore, there is a need for a bracket which may be mounted on the window without blemishing the molding or adjacent wall surface and without obscuring the decorative molding or corner blocks of the window.

Various curtain rod bracket designs are known which can be secured without damaging the outer facing of the window molding or the adjacent wall surface.. Examples of such brackets may be seen in U.S. Pat. No. 4,305,562, issued to Pitts N. Bellinger on Dec. 15, 1981; U.S. Pat. No. 4,964,604, issued to Emile Lombard on Oct. 23, 1990; and Canadian Pat. No. 691,319, issued to Melville E. Hymers on Jul. 28, 1964. However, none of the above referenced patents teach or suggest a bracket for mounting on the inside surface of the window frame, so as not to obscure the decorative molding or corner blocks of the window frame.

Additionally, curtain rod brackets which can be used to support numerous accessories, such as curtain rods, window shades, draperies, and other window treatments, are known in the art. The advantage of such brackets is that numerous supporting fixtures or brackets are no longer required - a single multi-purpose bracket may be used. Examples of such multi-purpose brackets may be seen in U.S. Pat. No. 551,080, issued to James A. Gilfillan et al. on Dec. 10, 1895; U.S. Pat. No. 1,713,299, issued to John Rasp on May 14, 1929; U.S. Pat. No. 1,752,743, issued to Myrtle L. Kall on Apr. 1, 1930; U.S. Pat. No. 4,684,095, issued to Wilber J. Athey on Aug. 4, 1987; and U.S. Pat. No. 5,082,226, issued to Larry G. Mahan on Jan. 21, 1992. None of the above referenced patents teaches or suggests a bracket which may be mounted on the window without blemishing the molding or adjacent wall surface and without obscuring the decorative molding or corner blocks of the window.

U.S. Pat. No. 1,276,823, issued to William T. Sullivan on Aug. 27, 1918, shows a double roller shade bracket for mounting on the inside surface of a window frame. Sullivan does not teach or suggest a bracket having an extension including a retaining member for supporting a curtain rod.

U.S. Pat. No. 1,384,273, issued to Fredrick C. Palosky et al. on Jul. 21, 1921, shows a curtain and shade bracket for mounting on the inside surface of a window frame. Palosky does not teach or suggest a bracket having a base and an extension projecting perpendicularly from the base for supporting a curtain rod.

None of the above inventions and patents, taken either singly or in combination, is seen to describe the instant invention as claimed.

SUMMARY OF THE INVENTION

The present invention is directed to a bracket for supporting a curtain rod for use with an opening such as a window. The bracket is designed to be mounted on the inside surface of the window frame to prevent marring of the window molding or adjacent wall surface facing the interior of the room and to allow viewing of the window molding and the corner blocks around the window. The bracket is characterized by a main portion, a first extension, and a retaining member.

The main portion includes a hole formed therein for receipt of attachment means, such as a wood screw or nail. The first extension projects from the main portion and includes a first end distal to the main portion. The retaining member is displaced from the first end to provide a supporting surface for supporting the curtain rod such that the bracket is capable of supporting the rod in proximity to the window when the main portion is secured to the inside surface of the window frame.

In the first embodiment of the present invention, the first extension extends perpendicularly from a plane defined by the main portion of the bracket, such that the bracket may support a rod positioned parallel to the window when the bracket is mounted on the inside of the window frame. This particular embodiment is particularly suited for use with window treatments such as shades, drapes, or undersheers. In alternative embodiments, multiple extensions may be added to the bracket,.including extensions that project perpendicularly from the opening, such that multiple curtain rods, for use with multiple window treatments including curtains, shades, undersheers, and valances, may be supported by a single bracket.

Accordingly, it is a principal object of the invention to provide a window bracket for mounting on the inside surface of an opening, such as a window, to preventing marring of the window molding or adjacent wall surface facing the interior of the room.

It is another object of the invention to provide a window bracket for mounting on the inside surface of an opening, such as a window, to allow viewing of the window molding and the corner blocks around the window.

It is a further object of the invention to provide a bracket having multiple extensions for supporting multiple rods and window treatments.

Still another object of the invention is to provide a rod, for use with the bracket of the present invention, including a longitudinal slot on the bottom surface thereof, to allow the rod to be lifted off the bracket without having to alter the length of the rod.

It is an object of the invention to provide improved elements and arrangements thereof in an apparatus for the purposes described which is inexpensive, dependable and fully effective accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
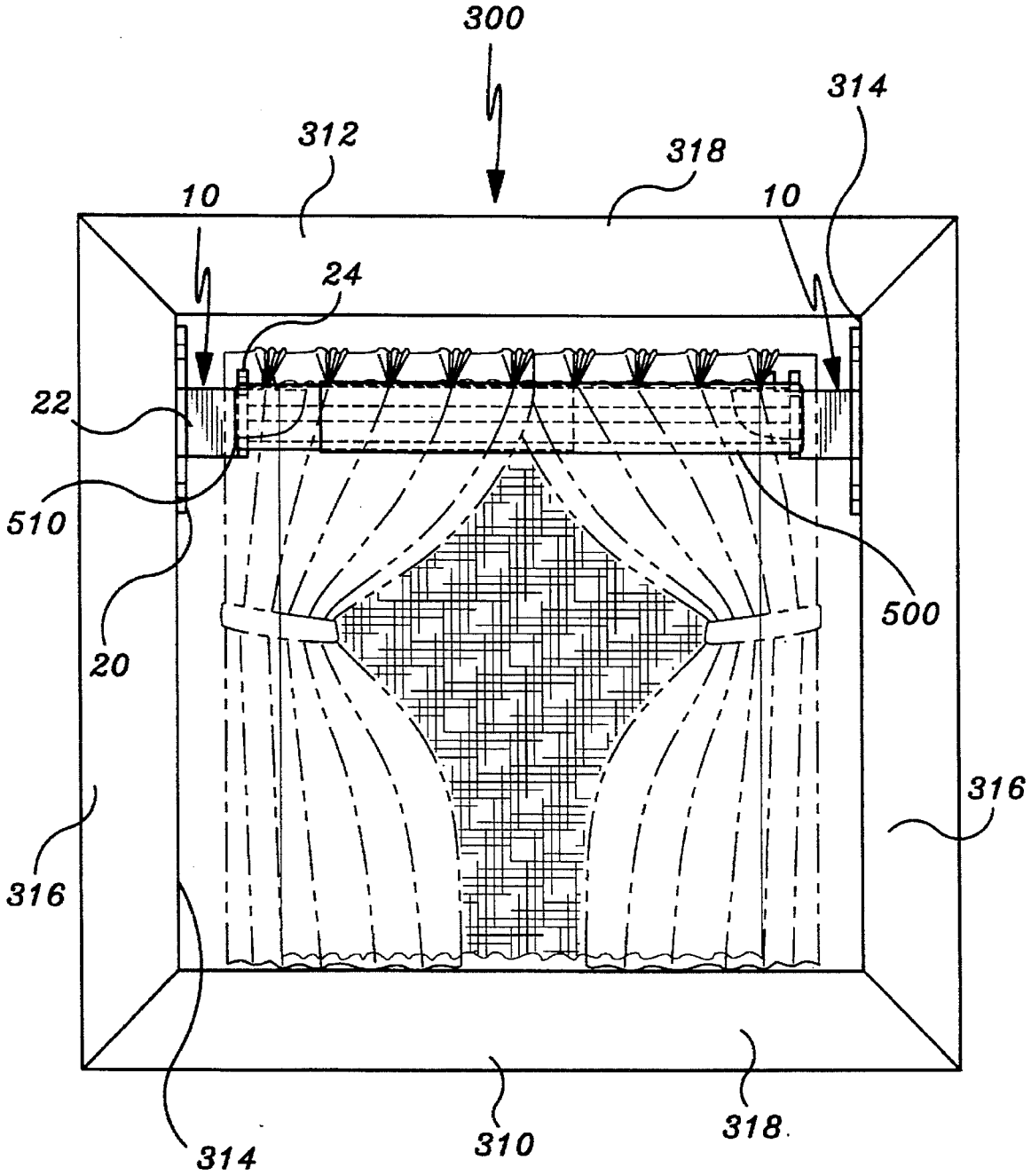
FIG. 1A is front elevational, environmental view of a pair of opposing brackets of the present invention, showing the brackets mounted on the inside surface of a window frame and supporting multiple curtain rods, the scale of the rods and brackets being exaggerated to emphasize details.
Figure 1B:
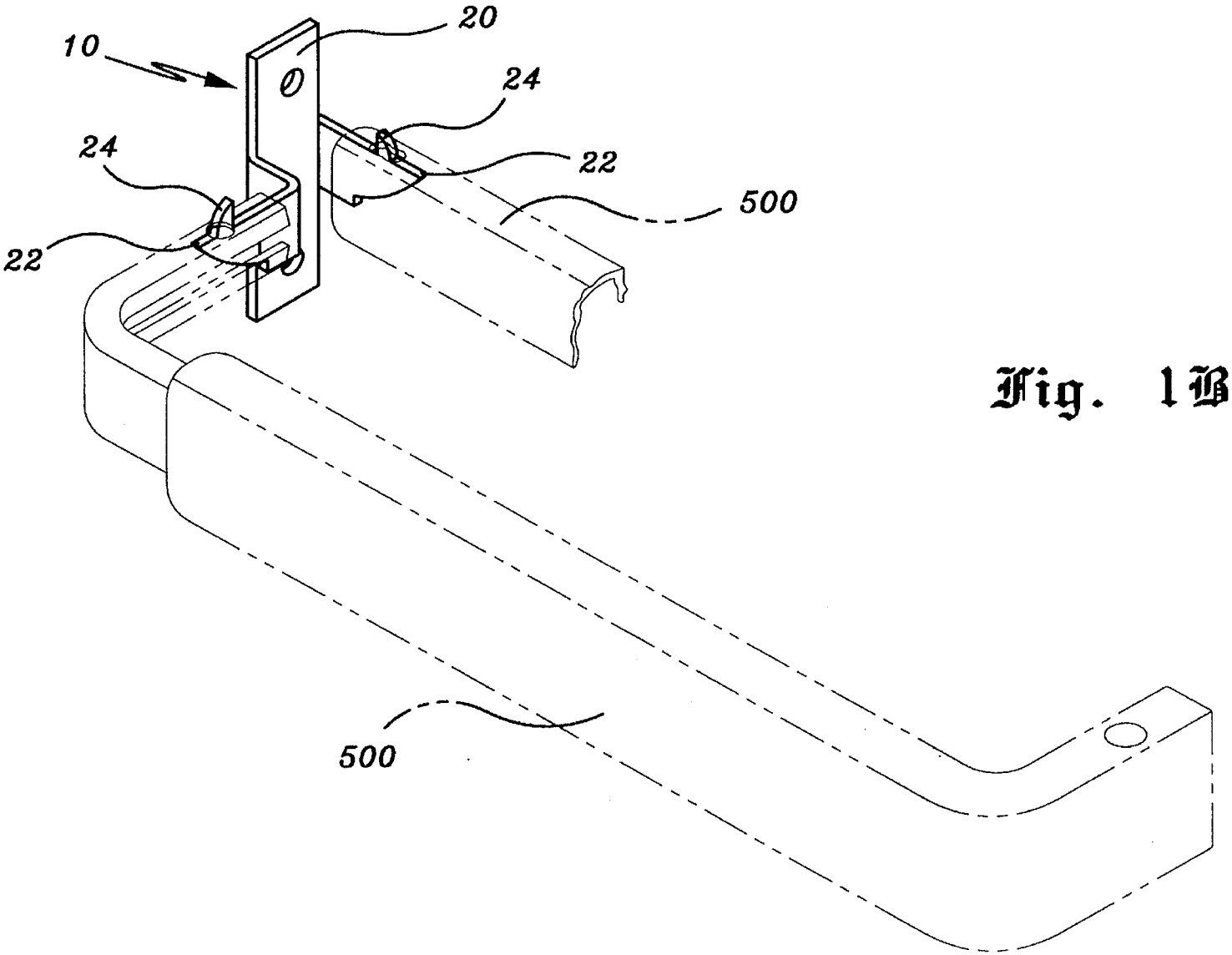
FIG. 1B is an environmental, perspective view of the bracket of the present invention, showing the bracket supporting multiple curtain rods.
Figure 2C:
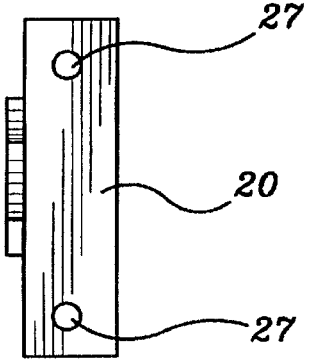
FIGS. 2A–E are orthographic views of a first embodiment of the invention, showing a bracket for mounting on the left side of an opening.
Figure 2E:
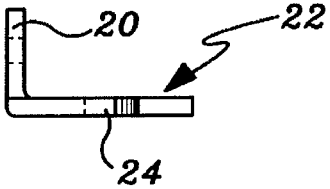
Figure 2A:
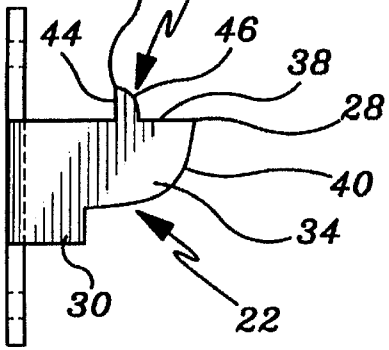
Figure 2D:
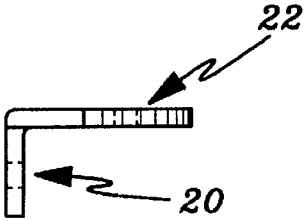
Figure 2B:
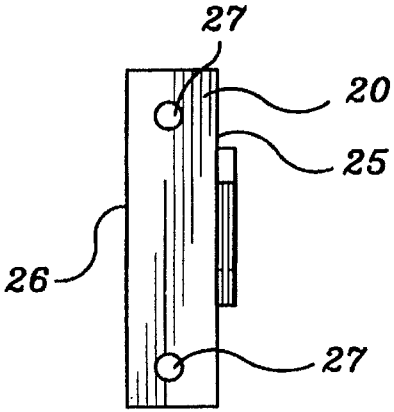
Figure 3C:
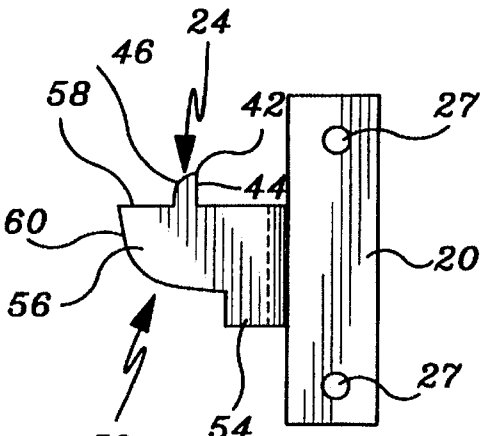
FIGS. 3A–E are orthographic views of a second embodiment of the invention, showing a bracket for mounting on the left side of an opening.
Figure 3E:
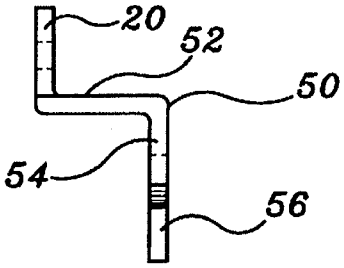
Figure 3A:
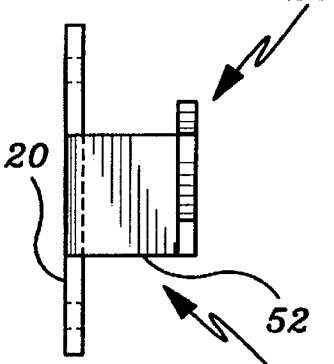
Figure 3B:
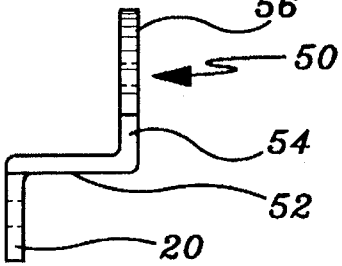
Figure 3D:
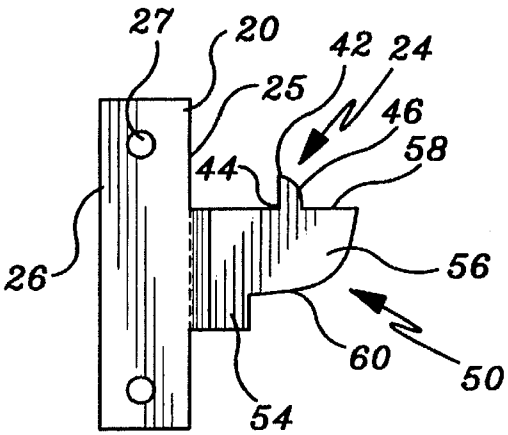
Figure 4E:
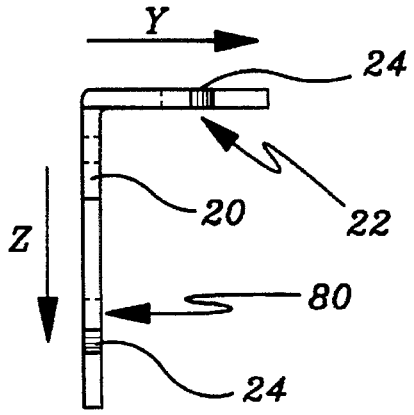
FIGS. 4A–E are orthographic views of a third embodiment of the invention, showing a bracket for mounting on the left side of an opening.
Figure 4B:
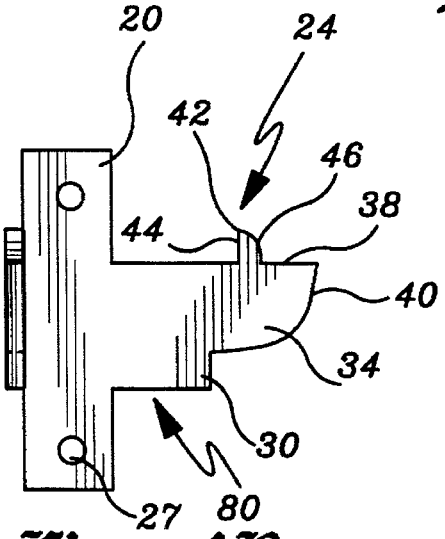
Figure 4A:
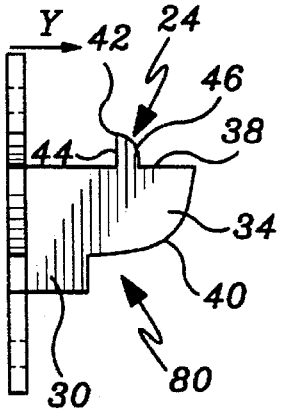
Figure 4C:
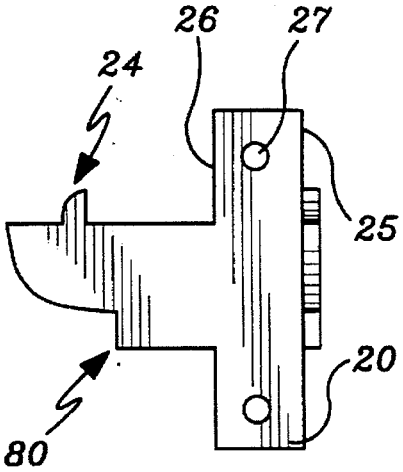
Figure 4D:
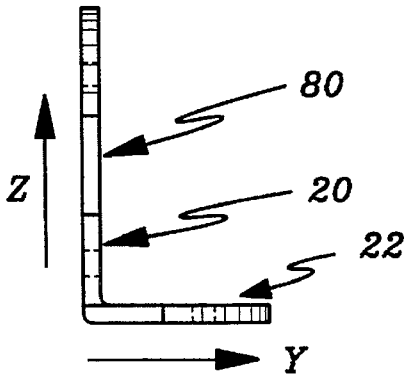
Figure 5E:
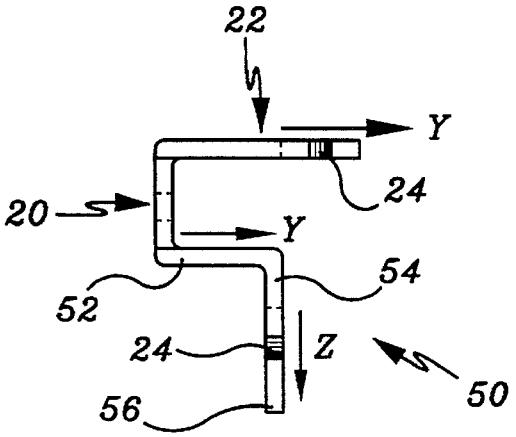
FIGS. 5A–E are orthographic views of a fourth embodiment the invention, showing a bracket for mounting on the left side of an opening.
Figure 5B:
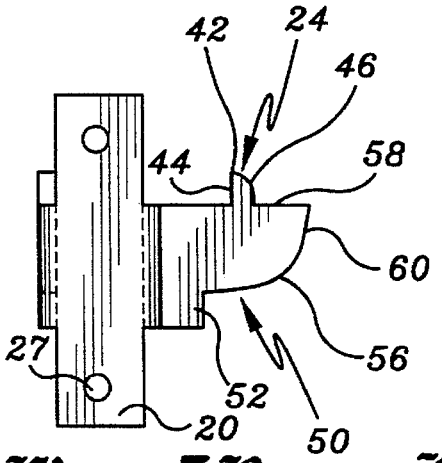
Figure 5A:
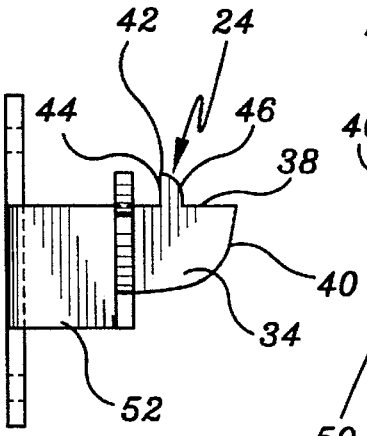
Figure 5C:
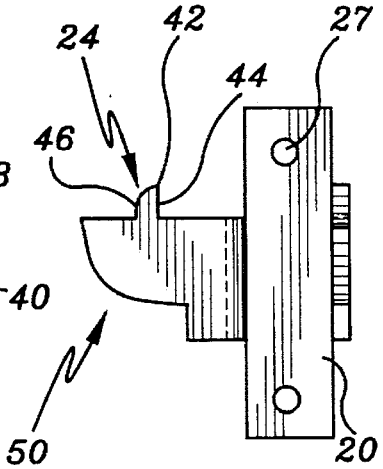
Figure 5D:
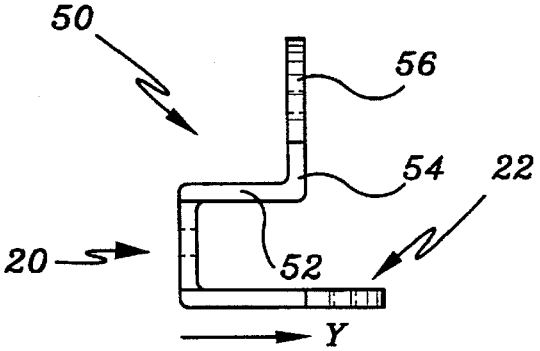
Figure 6E:
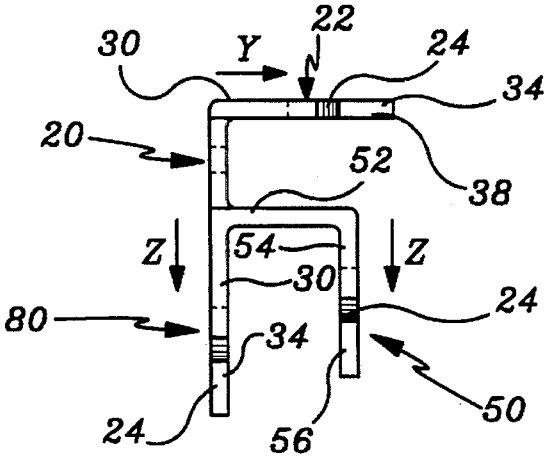
FIGS. 6A–E are orthographic views of a fifth embodiment of the invention, showing a bracket for mounting on the left side of an opening.
Figure 6B:
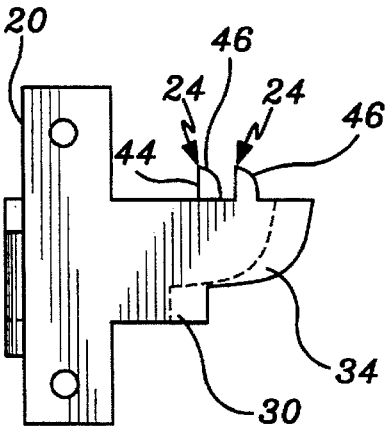
Figure 6A:
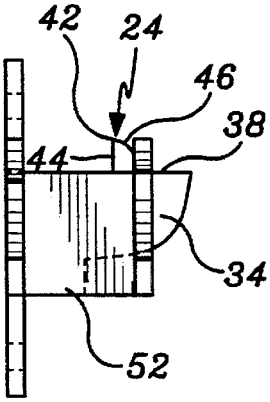
Figure 6C:
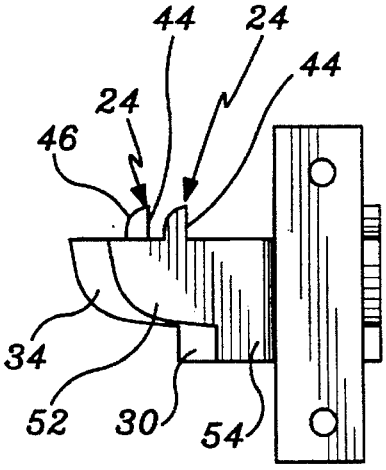
Figure 6D:
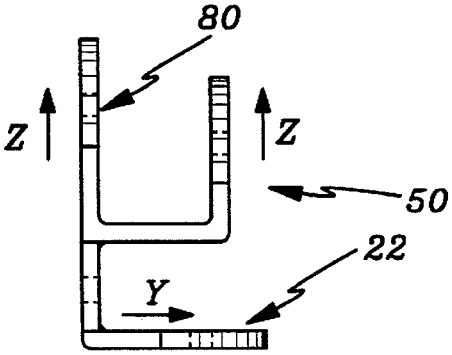
Figures 7A, 7B, 7C, 7D, 7E:
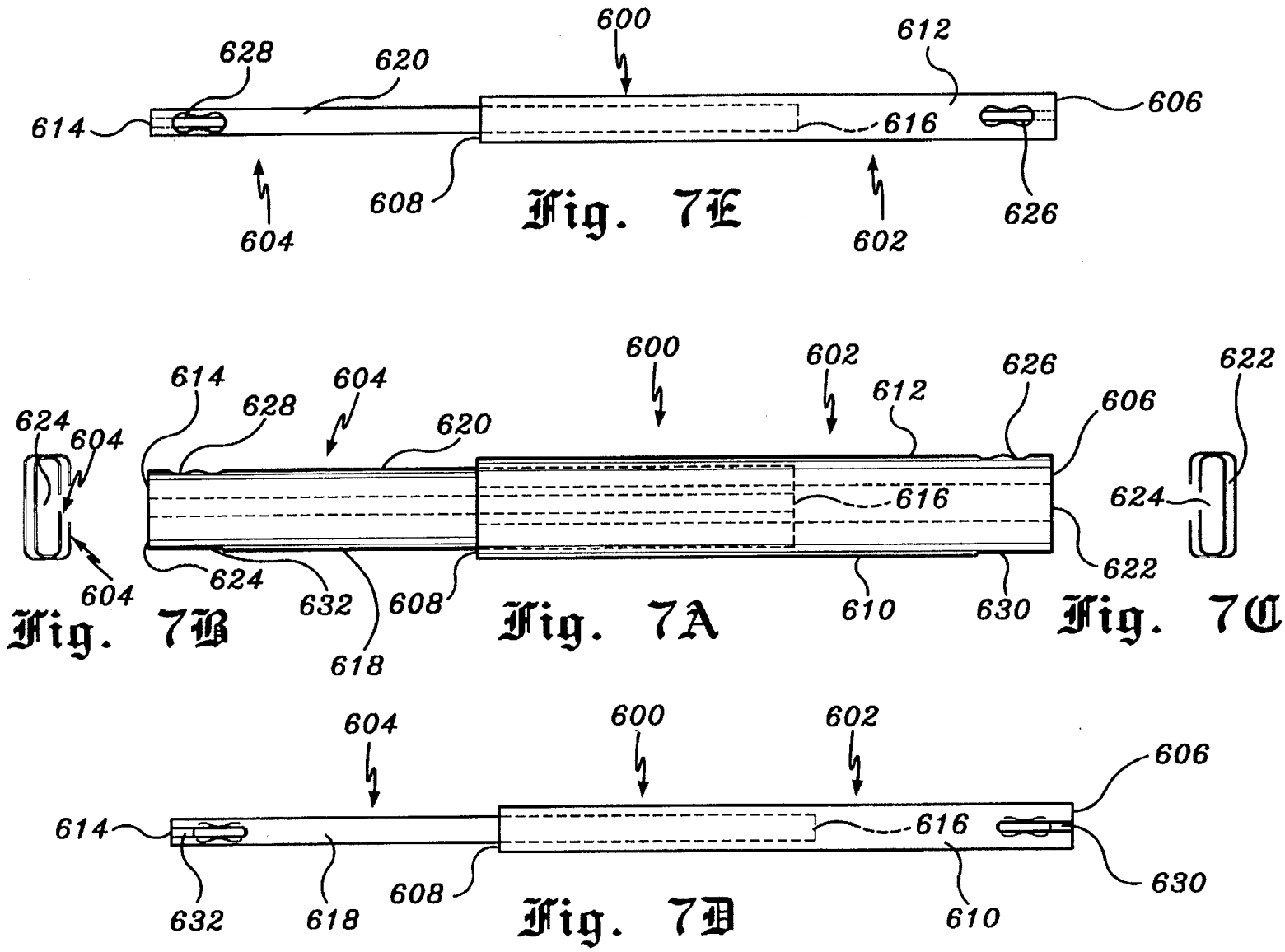
FIGS. 7A–E are orthographic views of a rod to be used with the bracket of the present invention.

A pair of opposing brackets 10 for supporting a curtain rod for use with an opening, such as a window 300, is shown installed in FIG. 1A. The conventional components of window 12 include window frame 310, window molding 312, and inside surface 314. Window frame 310 is defined by two parallel vertical members 316 and two parallel horizontal members 318. Also shown are rods 500 supported by bracket 10. Rods 500 are conventional curtain rods having a C-shaped cross section and openings 510 at either end. The main components of bracket 10 include a main portion 20, an extension 22, and a retaining member 24.

Referring to FIGS. 2A–E, a first embodiment of the present invention is shown. The first embodiment is designed to support rod 500 when it is to be positioned within window frame 310 between parallel vertical members 316. Main portion 20 is in the form of a generally flat, rectangular plate having a first side 25 and a second side 26. Main portion 20 also includes a pair of holes 27 for receipt of attachment means (not shown) to secure bracket 10 to inside surface 18 of window 300. The attachment means are preferably wood screws; however, any other well known attachment means may be used, including nails or tacks.

Extension 22 projects perpendicularly from a plane defined by main portion 20 and includes first end 28 distal to main portion 20. Extension 22 further includes a first portion 30 and a second rod engaging portion 34. First portion 30 is generally rectangular in shape. The width of second portion 34 is smaller than the width of first portion 30 such that second portion 34 may fit inside openings 510 of rod 500. Second portion 34 includes a first or top edge 38 and a second edge 40. First edge 38 and second or bottom edge 40 extend between first portion 30 and first end 28. Second edge 40 is generally arcuate in shape.

Retaining member 24 extends perpendicularly from first edge 38 and includes a first end 42. Retaining member 24 includes a third edge 44 and a fourth edge 46. Third edge 44 extends perpendicularly to first end 42. Fourth edge 46 is generally arcuate in shape. Retaining member 24 is displaced from first end 28 thus providing a supporting surface on first edge 28 for supporting rod 500. Retaining member 24 is sized to engage an aperture in rod 500 such that rod 500 may not be removed from bracket 10 without first lifting rod 500.

Referring to FIGS. 3A–E, a second embodiment of the present invention is shown. In the second embodiment bracket 10 includes an extension 50 having a first portion 52, a second portion 54, and a third portion 56. First portion 52 projects perpendicularly from a plane defined by main portion 20. Second portion 54 projects perpendicularly from the plane defined by first portion 52. First portion 52 and second portion 54 are generally rectangular in shape. The width of third portion 56 is smaller than the width of second portion 54 such that third portion 56 may fit inside openings 510 of rod 500. Third portion 56 includes a first edge 58 and a second edge 60. First edge 58 and second edge 60 extend between second portion 54 and first end 28. Second edge 60 is generally arcuate in shape. Retaining member 24 extends perpendicularly from first edge 58. When opposing brackets 10 are mounted within window frame 310, the ends of rod 500 engage extensions 50 and allow rod 500 to be positioned at a greater distance from window 300.

Referring to FIGS. 4A–E, a third embodiment of bracket 10 is shown. The third embodiment includes extension 22 projecting perpendicularly from the plane defined by main portion 20 in a first direction, indicated by arrow Y, and a second extension 80. Second extension 80 is identical to extension 22 except for the differences noted below. Second extension 80 projects from main portion 20 in a second direction, indicated by arrow Z, and lies in the plane defined by main portion 20.

This third embodiment of bracket 10 is designed to support two rods. One rod may be positioned within window frame 310 between parallel vertical members 316 and is supported by extension 22 and a second rod to be positioned parallel to the first rod at a greater distance from window 300 and is supported by second extension 80.

Referring to FIGS. 1B and 5A–E, a fourth embodiment of the present invention is shown. The fourth embodiment includes extension 22 projecting perpendicularly from the plane defined by main portion 20 in the first direction, indicated by arrow Y, and a second extension 50. First portion 52 of extension 50 projects perpendicularly from the plane defined by main portion 20, in the first direction. Second portion 54 and third portion 56 of extension 50 project perpendicularly from first portion 52 in the second direction, indicated by arrow Z.

This fourth embodiment of bracket 10 is designed to support two rods. One rod may be positioned within window frame 310 between parallel vertical members 316 and is supported by extension 22 and a second rod to be positioned parallel to the first rod at a greater distance from window 300 and is supported by second extension 50.

Referring to FIGS. 6A–E, a fifth embodiment of the present invention is shown. The fifth embodiment of bracket 10 is identical to the third embodiment of bracket 10, described above, except for the differences described below. A third extension 50, is added to bracket 10. First portion 52 of extension 50 projects perpendicularly from the plane defined by main portion 20, in the first direction. Second portion 54 and third portion 56 of extension 50 project perpendicularly from first portion 52 in the second direction, indicated by arrow Z.

This fifth embodiment of bracket 10 is designed to support three rods. One rod may be positioned within window frame 310 between parallel vertical members 316 and is supported by extension 22. A second rod to be positioned parallel to the first rod at a greater distance from window 300 and is supported by third extension 50. A third rod-to be positioned parallel to the second rod at an even greater distance from window 300 and is supported by second extension 80.

It will be apparent to one skilled in the art that the type of rod used with the brackets of the current invention is not limited the conventional rod described above. Any rod having a hollow interior, sufficiently large openings at the ends, and apertures for accommodating the retaining members, may be used with the brackets of the present invention.

Referring to FIG. 7A–E, a rod 600 for use with bracket 10 of the present invention is shown. Rod 600 includes a first section 602 and a second section 604. First section 602 includes a C-shaped cross section, a first end 606, a second end 608, a bottom surface 610 and a top surface 612. Second section 604 includes a C-shaped cross section, a first end 614, a second end 616, a bottom surface 618 and a top surface 620. The width of first section 602 is greater than the width of second section 604 such that second section 604 may slidably engage first section 602 along their respective longitudinal axes.

First section 602 includes an opening 622 sized to receive extension 22 of bracket 10. Opening 622 is positioned at first end 606. Second section 604 includes an opening 624 sized to receive extension 22 of bracket 10. Opening 624 is positioned at first end 614.

First section 602 includes an aperture 626 formed in top surface 612 proximate first end 606. Aperture 626 is sized to receive retaining member 24. Second section 604 also includes an aperture 628 formed in top surface 620 proximate first end 614. Aperture 628 is sized to receive retaining member 24.

First section 602 includes a longitudinal slot 630 formed within bottom surface 610 proximate first end 606. Longitudinal slot 630 communicates with opening 622 and is sized to receive retaining member 24 and extension 22. Second section 604 includes a longitudinal slot 632 formed within bottom surface 618 proximate first end 614. Longitudinal slot 632 communicates with opening 624 and is sized to receive retaining member 24 and extension 22.

Rod 600 is designed to be positioned within window frame 310 between vertical members 316. Longitudinal slots 630 and 632 facilitate attachment and removal of rod 600 to a pair of opposing brackets 10 by allowing rod 600 to be positioned without have to reduce the length of rod 600 by sliding second section 602 into first section 604. Thus, rod 600 may be vertically lowered on or lifted off brackets 10 to mount or remove rod 600, respectively.

It is to be understood that the present invention is not limited to the embodiments described above, but encompasses any and all embodiments within the scope of the following claims.

We claim:

1. A rod assembly for use with a window opening, the opening having a frame including an inside surface, said rod assembly comprising:

a rod having first end, a second end, and a bottom surface, said rod including a first opening formed therein at said first end and a second opening formed therein at said second end, said bottom surface having a first longitudinal slot formed therein proximate said first end and a second longitudinal slot formed therein proximate said second end, said first longitudinal slot communicating with said first opening, said second longitudinal slot communicating with said second opening; and a pair of opposing brackets for mounting on the inside surface of the frame, said pair of opposing brackets including a left bracket and a right bracket, each said bracket including:

a flat main portion having a first side and a second side and having a hole formed therein for receipt of attachment means;

a first extension projecting from said main portion at said first side, said first extension having a first end distal to said main portion, said first extension including a first portion perpendicularly connected to said main portion and a rod engaging portion at said first end, said first portion having a first width and said rod engaging portion having a second width smaller than said first width for insertion in said openings formed in the ends of said rod, said rod engaging portion including a top edge extending from said first end, said rod engaging portion including a bottom edge having an arcuate shape; and a retaining member extending from said top edge of said first portion and displaced from said first end to provide a supporting surface for supporting said rod, whereby said bracket is capable of supporting said rod in proximity to the opening when said main portion is secured to the inside surface of the frame.

* * * * *